United States Patent [19]

Schütz

[11] Patent Number: 5,044,510

[45] Date of Patent: Sep. 3, 1991

[54] BUNGHOLE-EQUIPPED BARREL

[76] Inventor: Udo Schütz, Rückersteg 4, D-5418 Selters, Fed. Rep. of Germany

[21] Appl. No.: 548,846

[22] Filed: Jul. 6, 1990

[30] Foreign Application Priority Data

Jul. 13, 1989 [DE] Fed. Rep. of Germany ... 8908528[U]

[51] Int. Cl.[5] ..... A65D 25/28

[52] U.S. Cl. ..... 220/4.05; 220/606

[58] Field of Search ..... 220/5 R, 601, 608, 405, 220/606

[56] References Cited

U.S. PATENT DOCUMENTS

| | | | |
|---|---|---|---|
| 943,686 | 12/1909 | Kruse | 220/601 |
| 3,827,595 | 8/1974 | Reynolds | 220/601 X |
| 3,938,687 | 2/1976 | Maier et al. | 220/4.05 |
| 4,201,306 | 5/1980 | Dubois et al. | 220/5 R |
| 4,228,911 | 10/1980 | Hammes | 220/606 X |
| 4,372,458 | 2/1983 | Carlson | 220/5 R X |
| 4,736,864 | 4/1988 | Hammes et al. | 220/601 |
| 4,767,021 | 8/1988 | Pies | 220/601 X |
| 4,776,479 | 10/1988 | Schutz | 220/5 R |
| 4,779,754 | 10/1988 | Ten Eyck et al. | 220/5 R X |
| 4,925,049 | 5/1990 | Przytulla | 220/5 R X |

*Primary Examiner*—Steven M. Pollard

*Attorney, Agent, or Firm*—Young & Thompson

[57] ABSTRACT

Bunghole-equipped barrel of a synthetic resin with a blow-molded sidewall with a bottom, and with a lid made of a plastic injection-molded component with integrally molded-on bungholes. The lid (4) has a central, trough-like indentation (9) which in a substantially upended position (1') of the barrel (1), forms a shallow drainage dome (10) sloping downward toward the bunghole orifices (7, 8). The lid (4) has an outer ring (12) having an L-profile serving as a supporting ring, carrying ring, and roller chime, projecting past the bungholes (5, 6) in a direction parallel to the longitudinal axis (11—11) of the barrel. Ridges (15, 16) extend from the lid (4) at a spacing around the bungholes (5, 6) and have the same height (17) as the outer ring (12) for protecting the bungholes (5, 6) and for supporting a stacked barrel.

7 Claims, 3 Drawing Sheets

BUNGHOLE-EQUIPPED BARREL

Figure 1:
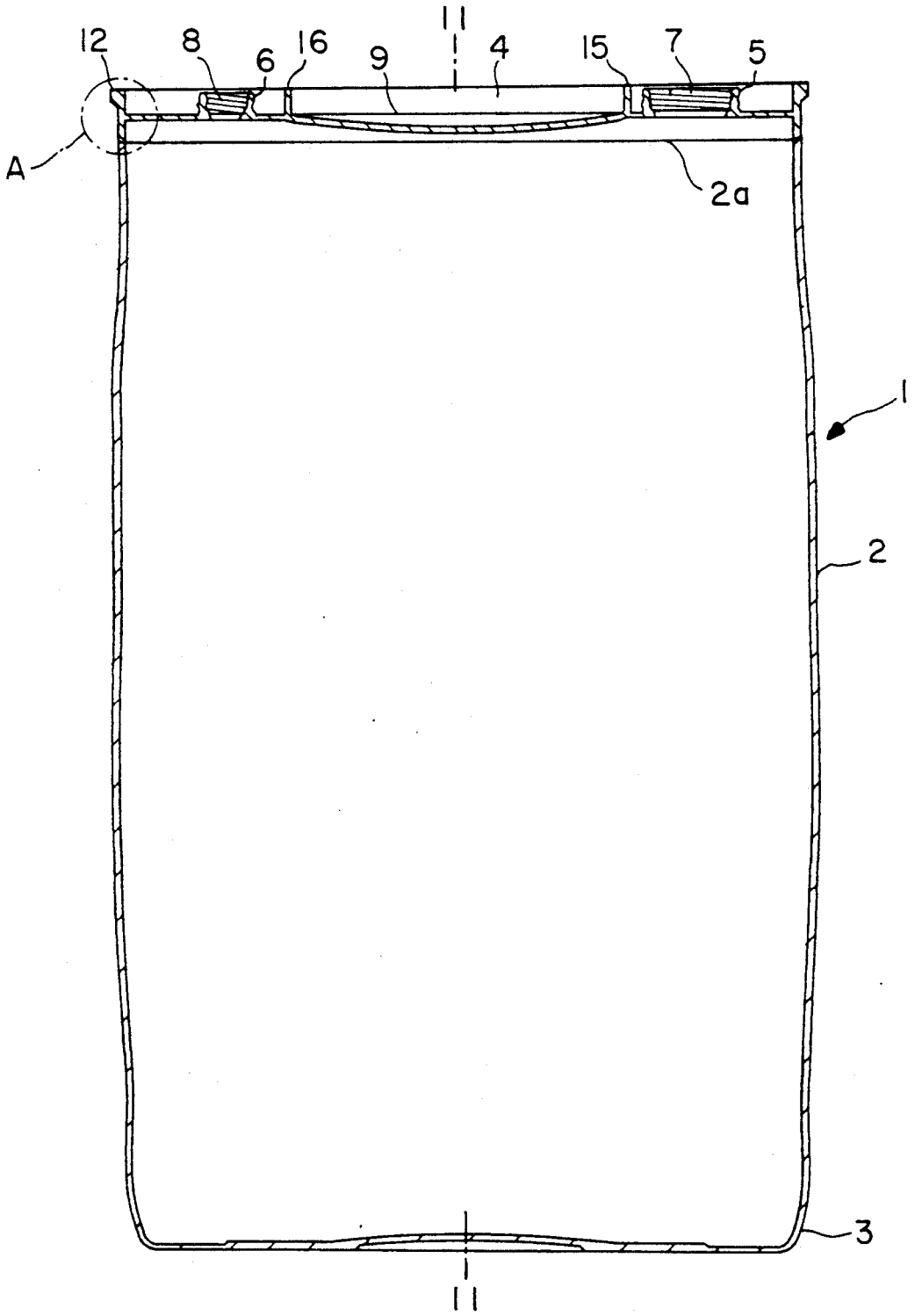

The invention relates to bunghole-equipped barrels of a synthetic resin with a sidewall section, a bottom end, and a head end with integrally molded-on bungholes.

A bunghole-equipped barrel with a device for emptying the residual content has been known from German Utility Model 86 31 318.5, this device being formed by collecting pans molded around the bunghole openings on the inside of the head end. For emptying the residual content, the barrel is tilted out of the horizontal position so that the residual fluid that has accumulated in a collecting pan can flow out of the barrel through the associated bunghole orifice. A disadvantage resides in that this emptying process must be repeated several times since the collecting pans exhibit only a limited capacity and consequently, with too high a liquid level in a collecting pan, the liquid will spill during tilting over the barrier of the collecting pan, this barrier descending from the inner head end rim toward the bunghole orifice, and will flow into the head end and/or the barrel sidewall.

The invention is based on the object of developing a bunghole-equipped barrel which can be emptied, without leaving any residue, in one working step.

The structure of the head end in accordance with this invention makes it possible to completely empty the barrel by once upending the barrel, or by setting the barrel approximately on end.

Figure 2:
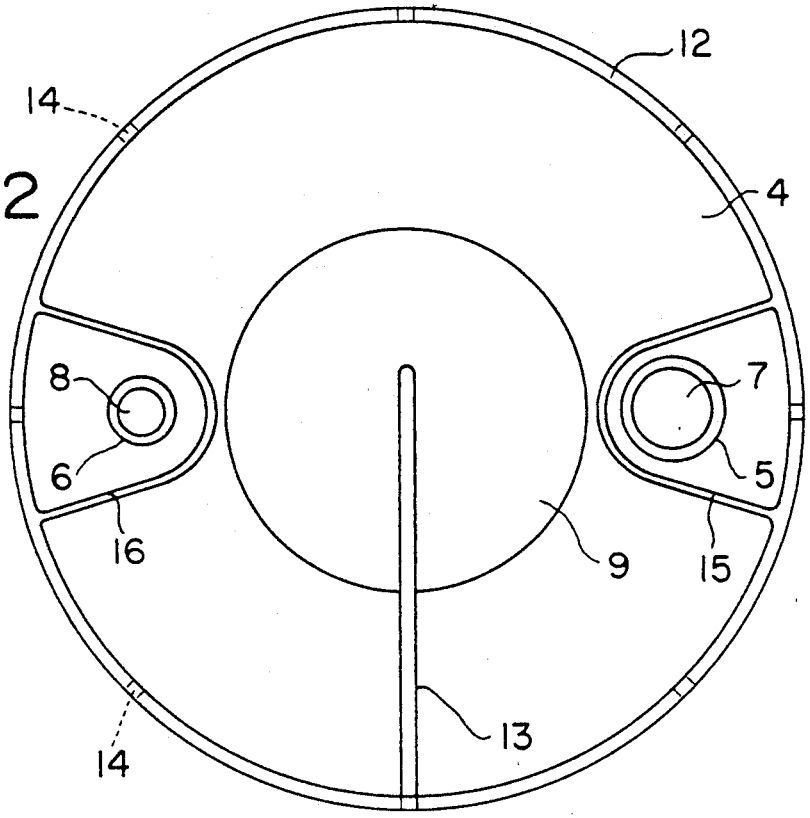
Figure 5:
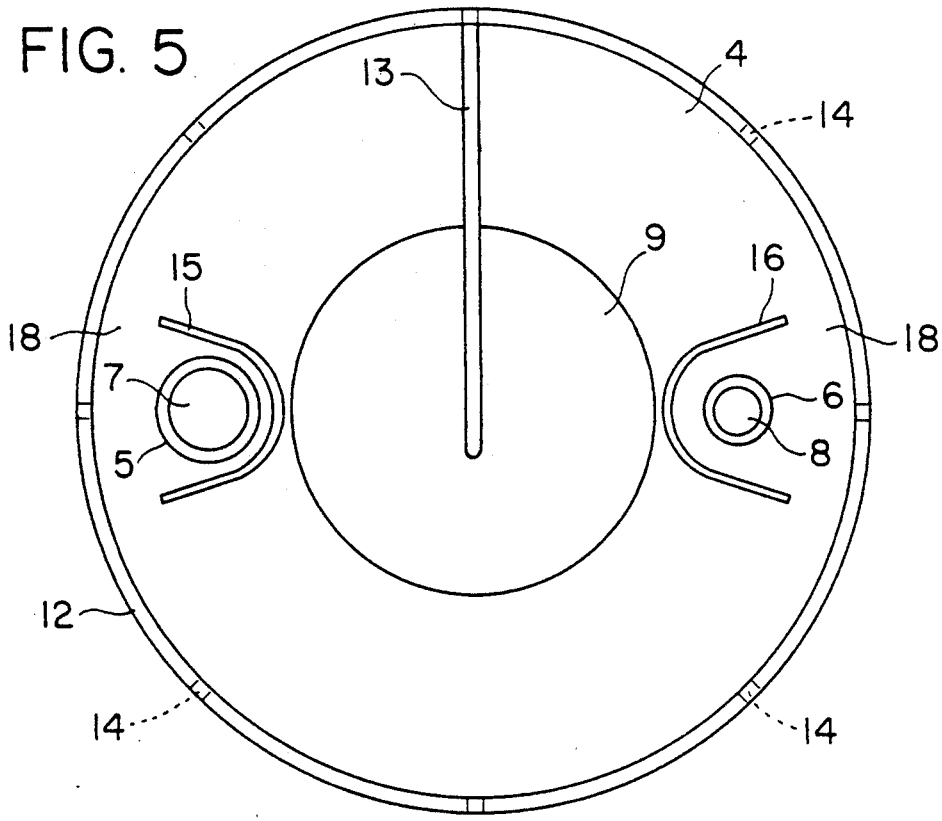
Figure 3:
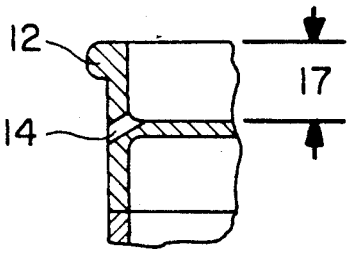
Figure 4:
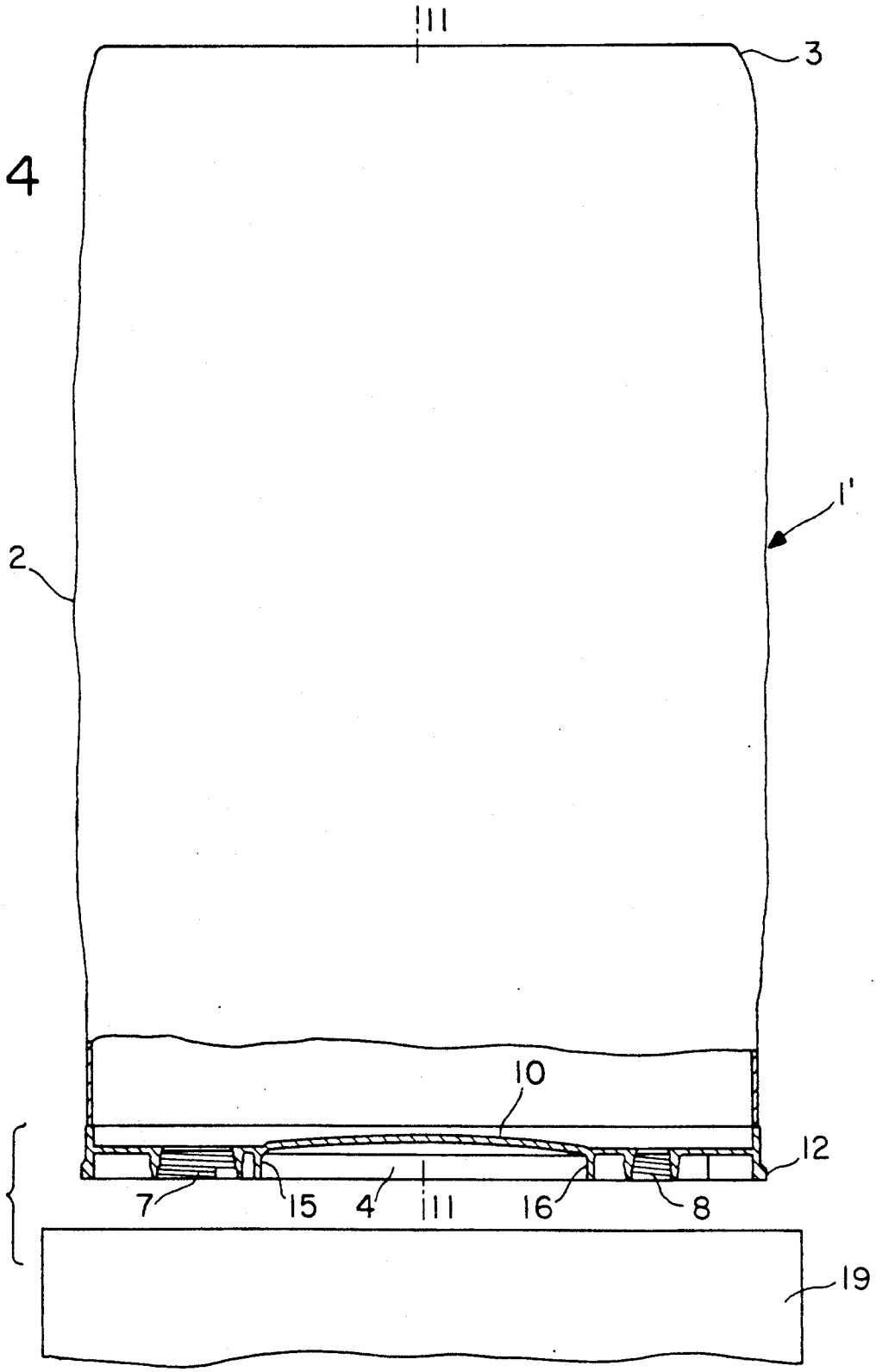

The invention will be described in greater detail below with reference to two embodiments illustrated in the drawings wherein:

FIG. 1 is a longitudinal sectional view of the bunghole-equipped barrel according to the invention, FIG. 2 shows a top view of the bunghole-equipped barrel, FIG. 3 shows a detail according to area A in FIG. 1, on an enlarged scale, FIG. 4 shows the barrel in the upended position for emptying, and FIG. 5 is a top view of the barrel with a modified configuration of the head end in the zone of the bungholes.

The bunghole-equipped barrel 1, consisting of a synthetic resin, comprises a sidewall section 2, a bottom end 3, and a head end 4, wherein the sidewall section 2 and the bottom end 3 are integrally blow-molded, and the head end 4, manufactured as an injection-molded plastic part, is welded to the sidewall section 2 at 2*a* over the circumference.

The lid section 4 exhibits two diametrically opposite, integrally molded bungholes 5, 6 designed for a screw cap and forming bunghole orifices 7, 8 which can be sealed with corresponding screw cap plugs.

The head end 4 has a central, trough-like indentation 9 forming, in an upended position 1' or an approximately upended position of the barrel 1 according to FIG. 4 for residual emptying, a shallow drainage dome 10 for the residual liquid, this dome sloping toward the bunghole openings 7, 8.

An outer ring 12 with an L-shaped profile, arranged on the circumference of the head end 4 and projecting past the bungholes 5, 6 in a direction parallel to the longitudinal axis 11—11 of the barrel, serves as a supporting ring for placing a barrel thereon, protecting the bungholes 5, 6 against damage, and it also serves as a carrying ring for engagement by the gripper of a conveying means, and as a roller chime.

From the central indentation 9 of the lid end 4, a flat drainage channel 13 for rainwater extends in the radial direction toward the outside through the outer ring 12. Additionally, drainage openings 14 are provided distributed along the circumference of the outer ring 12 (FIGS. 2 and 3).

Protective ridges 15, 16 having the same height 17 as the outer ring 12 and serving as supporting strips for a stacked barrel extend from the outer ring 12 of the head end 4 at a spacing around the bungholes 5, 6.

In the head end arrangement illustrated in FIG. 5, the protective and supporting ridges 15, 16 for the bungholes 5, 6 exhibit interruptions 18 in the zone of the outer ring 12 so that the grippers of a conveying means can engage unimpeded over the entire circumference at the outer ring 12.

In another head end design (not shown), the protective ridges 15, 16 for the bungholes 5, 6 are omitted.

In the upended position 1', or in an approximately upended position of the barrel 1, the residual liquid drains via the drainage dome 10 of the lid 4 and the bunghole openings 7, 8 toward the outside into a collecting container 19 (FIG. 4).

I claim:

1. Bunghole-equipped barrel of a synthetic resin with a blow-molded sidewall with a bottom, and with a lid made of a plastic injection-molded component with integrally molded-on bungholes, the lid (4) having a central, trough-like indentation (9) which in a substantially upended position (1') of the barrel (1), forms a shallow drainage dome (10) sloping downward toward the bunghole orifices (7, 8), the lid (4) having an outer ring (12) having an L-profile serving as a supporting ring, carrying ring, and roller chime, projecting past the bungholes (5, 6) in a direction parallel to the longitudinal axis (11—11) of the barrel, and ridges (15, 16) extending from the lid (4) at a spacing around the bungholes (5, 6) and at least partially surrounding the bungholes and having the same height (17) as the outer ring (12) for protecting the bungholes (5, 6) and for supporting a stacked barrel.

2. Bunghole-equipped barrel according to claim 1, wherein said central, trough-like indentation (9) terminates in a radially outward direction a distance from said bungholes (5, 6) and is surrounded by a substantially uniplanar annular portion of said lid (4).

3. Bunghole-equipped barrel according to claim 1, there being drainage openings (14) disposed in said outer ring (12).

4. Bunghole-equipped barrel according to claim 1, there being a shallow drainage channel (13) extending from said central indentation (9) through said outer ring (12).

5. Bunghole-equipped barrel according to claim 4, said drainage channel (13) extending radially of the barrel.

6. Bunghole-equipped barrel according to claim 1, said ridges (15, 16) having ends at which they join said outer ring (12).

7. Bunghole-equipped barrel according to claim 1, said ridges (15, 16) having ends that extend toward but terminate a distance from said outer ring (12).

* * * * *